US010814579B2

(12) United States Patent
Slayton et al.

(10) Patent No.: US 10,814,579 B2
(45) Date of Patent: Oct. 27, 2020

(54) SMOOTH AND BULKY ROLLED TISSUE PRODUCTS

(71) Applicant: Kimberly-Clark Worldwide, Inc., Neenah, WI (US)

(72) Inventors: Donald John Slayton, Appleton, WI (US); Samuel August Nelson, Menasha, WI (US)

(73) Assignee: KIMBERLY-CLARK WORLDWIDE, INC., Neenah, WI (US)

( * ) Notice: Subject to any disclaimer, the term of this patent is extended or adjusted under 35 U.S.C. 154(b) by 202 days.

(21) Appl. No.: 16/027,971

(22) Filed: Jul. 5, 2018

(65) Prior Publication Data

US 2018/0311924 A1 Nov. 1, 2018

Related U.S. Application Data

(63) Continuation of application No. 15/557,267, filed as application No. PCT/US2015/023476 on Mar. 31, 2015, now Pat. No. 10,040,265.

(51) Int. Cl.
*D21H 27/00* (2006.01)
*B31F 1/07* (2006.01)
(Continued)

(52) U.S. Cl.
CPC ..... *B31F 1/07* (2013.01); *A47K 10/16* (2013.01); *D21F 11/006* (2013.01); *D21F 11/14* (2013.01);
(Continued)

(58) Field of Classification Search
CPC .. D21H 27/002; D21H 27/004; D21H 27/005; D21H 27/007; D21H 27/02;
(Continued)

(56) References Cited

U.S. PATENT DOCUMENTS 3,817,827 A 6/1974 Benz
4,440,597 A 4/1984 Wells
(Continued)

FOREIGN PATENT DOCUMENTS

EP 0033988 B1 6/1986
EP 1004703 A1 5/2000
(Continued)

*Primary Examiner* — Eric Hug
(74) *Attorney, Agent, or Firm* — Kimberly-Clark Worldwide, Inc.

(57) ABSTRACT

The novel tissue products of the present invention are generally produced by calendering a tissue basesheet using at least one patterned roll. In one embodiment the patterned roll replaces the flat steel roll commonly used in calendering. The elements on the patterned roll provide a means of providing a nip having variable loading that yields a web having a smooth surface without subjecting the web to excessive compression forces and preventing excessive caliper loss. Thus, webs converted according to the present invention have comparable or better surface smoothness compared to webs converted using conventional calendering means and also retain a greater percentage of their caliper and bulk.

13 Claims, 2 Drawing Sheets

(51) Int. Cl.

| | |
|---|---|
| ***A47K 10/16*** | (2006.01) |
| ***D21F 11/00*** | (2006.01) |
| ***D21F 11/14*** | (2006.01) |
| ***D21G 1/02*** | (2006.01) |
| ***D21H 27/02*** | (2006.01) |

(52) U.S. Cl.
CPC ..... *D21G 1/02* (2013.01); *D21H 27/002* (2013.01); *D21H 27/005* (2013.01); *D21H 27/02* (2013.01); *B31F 2201/0733* (2013.01); *B31F 2201/0738* (2013.01)

(58) Field of Classification Search
CPC ... D21H 25/00; B31F 1/07; B31F 2201/0733; B31F 2201/0738; D21G 1/00; D21G 1/02; D21F 11/006; D21F 11/14; D21F 11/145
USPC ..... 162/117, 361, 362
See application file for complete search history.

(56) References Cited

U.S. PATENT DOCUMENTS

| | | | |
|---|---|---|---|
| 5,277,761 | A | 1/1994 | Van Phan |
| 5,336,373 | A | 8/1994 | Scattolino |
| 5,607,551 | A | 3/1997 | Farrington |
| 5,672,248 | A | 9/1997 | Wendt |
| 5,693,403 | A | 12/1997 | Brown |
| 5,702,571 | A | 12/1997 | Kamps |
| 5,743,999 | A | 4/1998 | Kamps |
| 5,840,403 | A | 11/1998 | Trokhan |
| 5,904,812 | A | 5/1999 | Salman |
| 6,033,523 | A | 3/2000 | Dwiggins |
| 6,077,590 | A | 6/2000 | Archer |
| 6,344,111 | B1 | 2/2002 | Wilhelm |
| 6,440,268 | B1 | 8/2002 | Baggot |
| 6,610,173 | B1 | 8/2003 | Lindsay |
| 6,733,608 | B1 | 5/2004 | Baggot |
| 6,802,937 | B2 | 10/2004 | Johnston |
| 6,849,147 | B2 | 2/2005 | Havard |
| 6,849,157 | B2 | 2/2005 | Farrington, Jr. |
| 7,156,954 | B2 | 1/2007 | Farrington, Jr. |
| 7,377,995 | B2 | 5/2008 | Chen |
| 7,419,569 | B2 | 9/2008 | Hermans |
| 7,611,607 | B2 | 11/2009 | Mullally |
| 7,879,189 | B2 | 2/2011 | Dyer |
| 8,652,597 | B2 | 2/2014 | Hermans |
| 8,834,978 | B1 | 9/2014 | Hermans |
| 8,852,398 | B2 | 10/2014 | Hermans |
| 9,410,290 | B2 | 8/2016 | Hermans |
| 9,915,033 | B2 | 3/2018 | Hermans |
| 2004/0101704 | A1 | 5/2004 | Hermans |
| 2004/0140076 | A1 | 7/2004 | Hermans |
| 2004/0200590 | A1 | 10/2004 | Wilhelm |
| 2004/0238135 | A1 | 12/2004 | Edwards |
| 2005/0067126 | A1 | 3/2005 | Horenziak |
| 2005/0136222 | A1 | 6/2005 | Hada |
| 2005/0161179 | A1 | 7/2005 | Hermans |
| 2005/0230069 | A1 | 10/2005 | Hilbig |
| 2007/0044928 | A1 | 3/2007 | Shannon |
| 2007/0056704 | A1 | 3/2007 | Wilke |
| 2007/0137808 | A1 | 6/2007 | Lostocco |
| 2008/0073045 | A1 | 3/2008 | Dyer |
| 2008/0099169 | A1 | 5/2008 | Beuther |
| 2008/0135195 | A1 | 6/2008 | Hermans |
| 2009/0057169 | A1 | 3/2009 | Kruchoski |
| 2009/0188636 | A1 | 7/2009 | Salaam |
| 2009/0242154 | A1 | 10/2009 | Beuther |
| 2010/0032867 | A1 | 2/2010 | Schmidt |
| 2011/0027563 | A1 | 2/2011 | Manifold |
| 2011/0129645 | A1 | 6/2011 | Dyer |
| 2013/0068868 | A1 | 3/2013 | Hermans |
| 2013/0199741 | A1 | 8/2013 | Stage |
| 2016/0002861 | A1 | 1/2016 | Goulet |
| 2016/0145808 | A1* | 5/2016 | Weaver ..... D21H 27/005 162/231 |
| 2016/0145809 | A1 | 5/2016 | Hermans |
| 2016/0355986 | A1 | 12/2016 | Goulet |

FOREIGN PATENT DOCUMENTS

| | | | |
|---|---|---|---|
| EP | 0806520 | B1 | 11/2002 |
| EP | 1208965 | B1 | 1/2006 |
| JP | 2013217004 | A2 | 10/2013 |
| WO | WO12059619 | A1 | 5/2012 |
| WO | WO14020424 | A1 | 2/2014 |
| WO | WO 2014/085582 | * | 6/2014 |
| WO | WO14085582 | A1 | 6/2014 |

* cited by examiner

SMOOTH AND BULKY ROLLED TISSUE PRODUCTS

RELATED APPLICATIONS

The present application is a continuation application and claims priority to U.S. patent application Ser. No. 15/557,267, filed on Sep. 11, 2017, which is a national-phase entry, under 35 U.S.C. § 371, of PCT Patent Application No. PCT/US15/23476 (PCT Publication No. WO/2016/159966), filed on Mar. 31, 2015, all of which are incorporated herein by reference.

BACKGROUND OF THE DISCLOSURE

In the manufacture of tissue products such as bath tissue, a wide variety of product characteristics must be given attention in order to provide a final product with the appropriate blend of attributes suitable for the product's intended purposes. Improving the surface properties of the tissue product, such as surface smoothness, while maintaining the Sheet Bulk, is a continuing objective in tissue manufacture, especially for premium products. These objectives must be further balanced with operational efficiency. One means of balancing these properties has been to manufacture the webs by a through-air drying process. Throughdrying provides a relatively noncompressive method of removing water from the web by passing hot air through the web until it is dry. More specifically, a wet-laid web is transferred from the forming fabric to a coarse, highly permeable throughdrying fabric and retained on the throughdrying fabric until it is at least almost completely dry. The resulting dried web is softer and bulkier than a wet-pressed sheet because fewer papermaking bonds are formed and because the web is less dense. Squeezing water from the wet web is eliminated, although subsequent transfer of the web to a Yankee dryer for creping is still often used to final dry and/or soften the resulting tissue.

When the single ply tissue products, however, are formed into a rolled product, the base sheets tend to lose a noticeable amount of bulk due to the compressive forces that are exerted on the base web during winding and converting. As such, a need currently exists for a process for producing a single ply tissue product that has both softness and bulk when spirally wound into a roll. More particularly, a need exists for a spirally wound product that can maintain a significant amount of Roll Bulk and sheet softness even when the product is wound under tension to produce a roll having consumer desired firmness.

SUMMARY OF THE DISCLOSURE

The present inventors have now discovered an alternative to conventional calendering which results in less Sheet Bulk loss, while producing a smoother, less stiff, tissue product that may be converted into a rolled product having improved firmness at a given Roll Bulk. Unlike conventional calendering, which employs a pair of opposed substantially smooth, unpatterned rolls, the instant invention employs a calender roll comprising male elements and landing areas. The male elements, which may generally be any shape, have a surface area greater than about 300 $mm^2$, such as from about 300 to about 8,000 $mm^2$ and more preferably from about 1,750 to about 3,000 $mm^2$ and cover from about 60 to about 98 percent of the surface of the roll and more preferably from about 70 to 95 percent of the surface of the roll. Tissue products produced using the patterned calender rolls have improved properties compared to products produced by conventional calendering.

Accordingly, in one embodiment the present invention provides a rolled tissue product comprising a calendered tissue web spirally wound into a roll, the product having a Roll Bulk greater than about 15 cc/g, a Roll Firmness from about 5.0 to about 7.0 and a Roll Structure greater than about 1.80.

In another embodiment the present invention provides a rolled tissue product comprising a calendered tissue web spirally wound into a roll, the product having a Roll Structure from about 1.80 to about 2.50, the web having a basis weight from about 35 to about 45 gsm, a Surface Smoothness less than about 0.260 and a geometric mean tensile (GMT) from about 1500 to about 3000 g/3".

In still another embodiment the present invention provides a bulky and smooth calendered tissue web having a Sheet Bulk greater than about 15 cc/g and Surface Smoothness less than about 0.260.

In yet another embodiment the present invention provides a patterned calender roll comprising a cylindrical roll having a roll surface comprising landing areas having a first elevation and male elements having a second elevation, wherein the distance between the first and second elevations (H) is from about 0.30 to about 2.0 mm and the male elements comprise from about 60 to about 95 percent of the total roll surface area.

In another embodiment the present invention provides a method of manufacturing a bulky and smooth tissue web comprising the steps of providing a tissue web, providing a patterned calender roll comprising a cylindrical roll having a roll surface comprising landing areas having a first elevation and male elements having a second elevation, wherein the distance between the first and second elevations (H) is from about 0.30 to about 2.0 mm and the male elements comprise from about 60 to about 95 percent of the total roll surface area, providing a resilient roll in opposition to the patterned calender roll and creating a calender nip there between, and passing the tissue web through the calender nip.

DEFINITIONS

Figure 1:
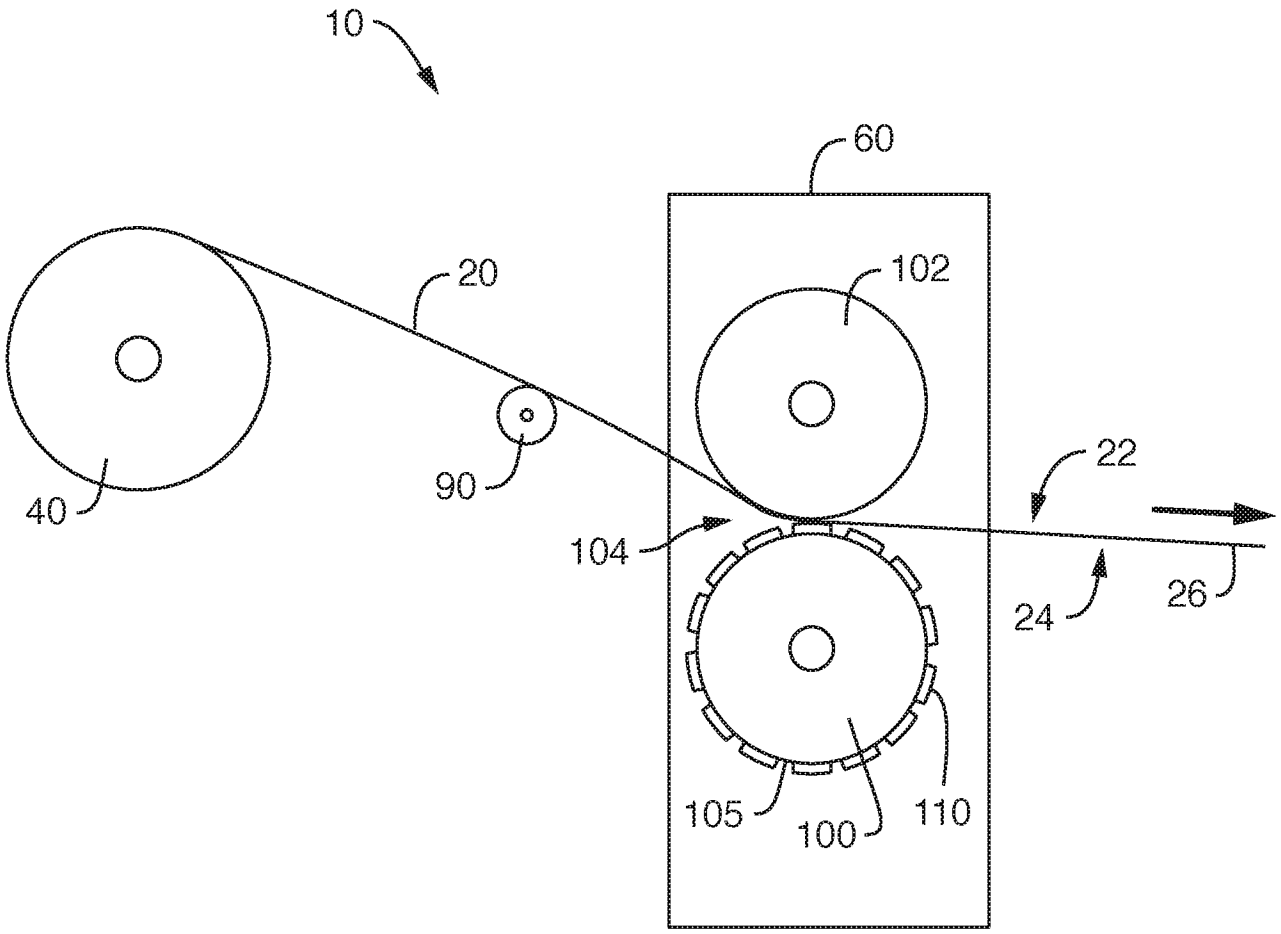
FIG. 1 is a schematic illustration of a converting process useful for preparing tissue products according to one embodiment of the present invention.

As used herein, the term "caliper" is the representative thickness of a single sheet (caliper of tissue products comprising two or more plies is the thickness of a single sheet of tissue product comprising all plies) measured in accordance with TAPPI test method T402 using an EMVECO 200-A Microgage automated micrometer (EMVECO, Inc., Newberg, Oreg.). The micrometer has an anvil diameter of 2.22 inches (56.4 mm) and an anvil pressure of 132 grams per square inch (per 6.45 square centimeters) (2.0 kPa). A total of ten sheets of tissue product are measured and the total is divided by ten to arrive at the single sheet caliper.

As used herein, the term "CD Stretch" refers to the stretch of a sample in the cross-machine direction and is an output of the tensile test described in the Test Methods section below.

As used herein, the term "basis weight" generally refers to the bone dry weight per unit area of a tissue and is generally expressed as grams per square meter (gsm). Basis weight is measured using TAPPI test method T-220.

As used herein, the term "Firmness" generally refers to Kershaw Firmness, which is measured using the Kershaw Test as described in detail in U.S. Pat. No. 6,077,590, which is incorporated herein by reference in a manner consistent with the present disclosure. The apparatus is available from Kershaw Instrumentation, Inc. (Swedesboro, N.J.) and is known as a Model RDT-2002 Roll Density Tester. Firmness generally has units of mm or cm.

As used herein, the term "geometric mean tensile" (GMT) refers to the square root of the product of the machine direction tensile and the cross-machine direction tensile of the web, which are determined as described in the Test Method section.

As used herein the term "ply" refers to a discrete product element. Individual plies may be arranged in juxtaposition to each other. The term may refer to a plurality of web-like components such as in a multi-ply facial tissue, bath tissue, paper towel, wipe, or napkin.

As used herein, the term "Roll Bulk" refers to the volume of paper divided by its mass on the wound roll. Roll Bulk is calculated by multiplying pi (3.142) by the quantity obtained by calculating the difference of the roll diameter squared (having units of centimeters squared) and the outer core diameter squared (having units of centimeters squared) divided by 4, divided by the quantity sheet length (having units of centimeters) multiplied by the sheet count multiplied by the bone dry basis weight of the sheet (having units of grams per square meter).

As used herein, the term "Roll Structure" generally refers to the overall appearance and quality of a rolled tissue product and is the product of Roll Bulk (having units of cc/g) and caliper (having units of cm) divided by Firmness (having units of cm). Roll Structure is generally referred to herein without reference to units.

As used herein, the term "Sheet Bulk" refers to the quotient of the caliper (μm) divided by the bone dry basis weight (gsm). The resulting Sheet Bulk is expressed in cubic centimeters per gram (cc/g).

As used herein, the term "slope" refers to slope of the line resulting from plotting tensile versus stretch and is an output of the MTS TestWorks™ in the course of determining tensile strength as described in the Test Methods section. Slope is reported in the units of kilograms (kg) per unit of sample width (inches) and is measured as the gradient of the least-squares line fitted to the load-corrected strain points falling between a specimen-generated force of 70 to 157 grams (0.687 to 1.540 N) divided by the specimen width. Slopes are generally reported herein as having units of kilograms (kg).

As used herein, the term "geometric mean slope" (GM Slope) generally refers to the square root of the product of machine direction slope and cross-machine direction slope. GM Slope generally is expressed in units of kilograms (kg) or grams (g).

As used herein, the term "Stiffness Index" refers to the quotient of the GM Slope (having units of grams) divided by the GMT (having units of g/3").

As used herein, the term "Surface Smoothness" refers to the average smoothness of the top and bottom surfaces of the tissue product and is calculated by averaging the square root of the product of MIU-CD and MIU-MD for the top and bottom surfaces. MIU-CD and MIU-MD refer to the surface friction in the cross-machine direction (CD) and machine direction (MD) for either the top or bottom surface of the tissue product measured using a KES Surface Tester (Model KE-SE, Kato Tech Co., Ltd., Kyoto, Japan) as described in the Test Methods section below.

As used herein, the term "tissue product" refers to products made from tissue webs and includes, bath tissues, facial tissues, paper towels, industrial wipers, foodservice wipers, napkins, medical pads, and other similar products.

As used herein, the terms "tissue web" and "tissue sheet" refer to a fibrous sheet material suitable for forming a tissue product.

DETAILED DESCRIPTION OF THE DISCLOSURE

The present invention provides a novel tissue product having improved Sheet Bulk and Surface Smoothness that when wound into a rolled tissue product have good Roll Bulk and Roll Structure. The novel tissue products of the present invention are generally produced by calendaring tissue basesheets using at least one patterned roll. In one embodiment the patterned roll replaces the flat steel roll commonly used in calendering. The elements on the patterned roll provide a means of providing a nip having variable loading such that Z-direction variability in the web is reduced, yielding a smoother web, but without subjecting the web to excessive compression forces and preventing excessive caliper loss. Thus, webs converted according to the present invention tend to retain a greater percentage of their caliper and bulk when converted compared to webs converted using conventional calendering means.

Referring to FIG. 1, an off-line converting operation 10 for converting a tissue web 20 is illustrated. Those skilled in the art will appreciate, although the converting operation 10 is illustrated as being off-line, a similar unit operation may be applied in-line. The tissue web 20 is unwound from the parent roll 40 and transported in sequence to a calendering unit 60. The calendered tissue web 26 may then be wound at a rewinding unit (not illustrated). For example, the calendered tissue web 26 may be wound onto tissue roll cores to form logs, which are subsequently cut to appropriate widths and the resulting individual tissue rolls can then be packaged.

The calendering unit 60 includes a pair of calendering rolls 100 and 102 that together define a calendering nip 104 there-between. A spreader roll 90 is shown preceding the calendering nip 104, although other details of the calendering unit 60 are not shown for purposes of clarity. In a particularly preferred embodiment the calender unit 60 comprises a patterned roll 100 having elements 110 elevated above the roll surface 105 and defining a pattern. The patterned roll 100 is mounted in opposition to a resilient roll 102 creating a nip 104 there-between. The web 20, having upper 22 and bottom 24 surfaces, passes through the nip 104 and emerges as a calendered web 26. As illustrated, the bottom surface 24 contacts the patterned roll 100, however, one skilled in the art will appreciate other configurations are possible. In addition to the calendering rolls having different surface patterns, the calendering nip may be a "soft-nip" wherein the calendering rolls have different surface hardness.

The resilient calendering may be a soft covered calender roll. For example, in certain embodiments, the exterior surface of the resilient calender roll 102 can include natural rubber, synthetic rubber, composites, as well as other compressible surfaces. A preferred material for the exterior surface of the resilient calender roll 102 is ethylene propylene diene polymer. This material is compressible and holds up well under pressure. Suitable resilient calendering rolls should have a Shore A surface hardness of from between about 65 to about 100 Durometer (approximately 75 to about 0 Pusey & Jones, respectively), preferably, from between about 75 to about 100 Durometer (approximately 55 to about 0 Pusey & Jones, respectively), and most preferably, from between about 85 to about 95 Durometer (approximately 35 to about 10 Pusey & Jones respectively). The use of a resilient calender roll 102 having an ethylene propylene diene polymer outer surface with a Shore A surface hardness of about 90 Durometer (approximately 25-30 Pusey & Jones) is particularly suited to the present process.

Figure 2:
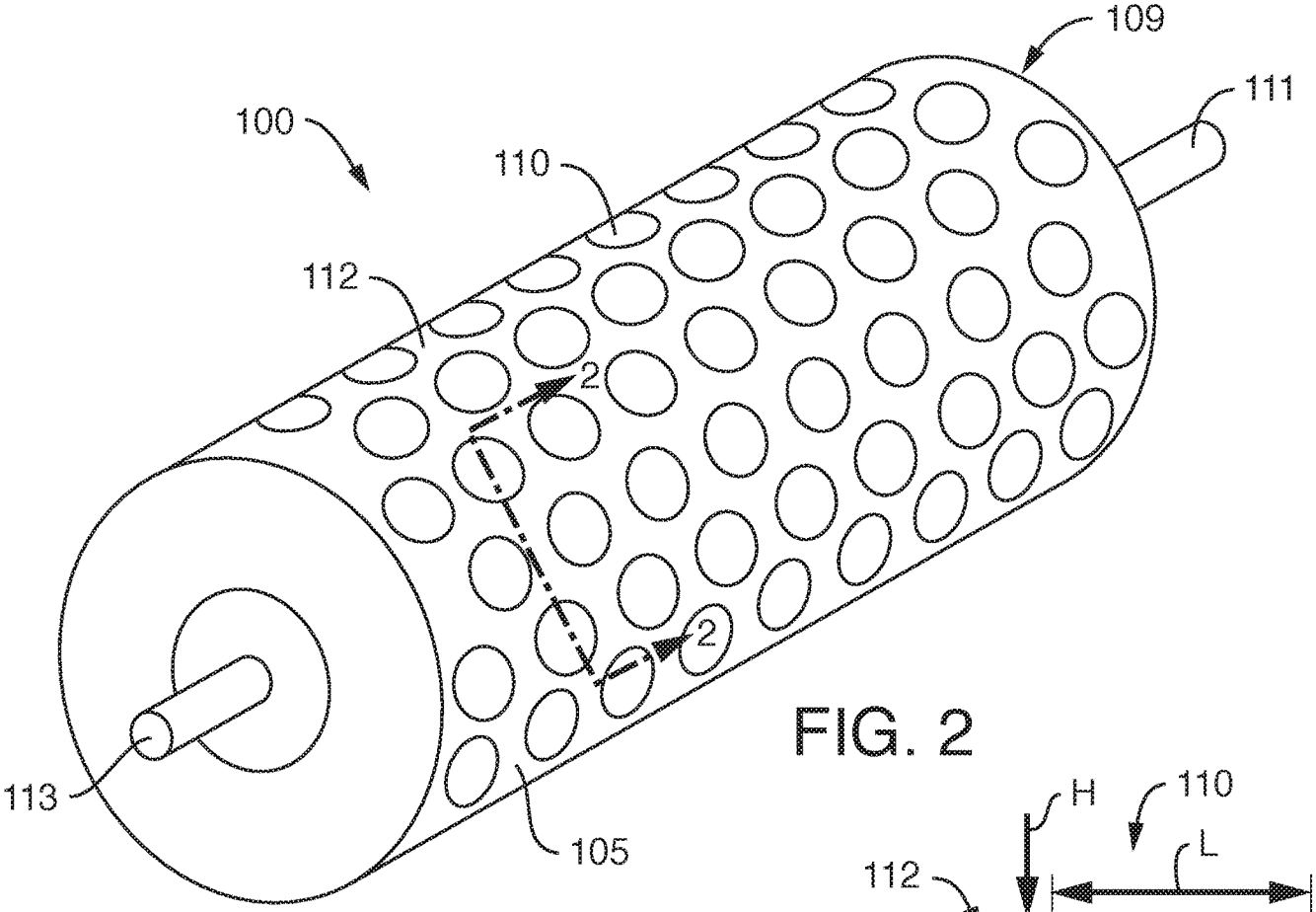
FIG. 2 is a perspective view of a patterned calender roll according to one embodiment of the present invention.

Opposite the resilient calender roll 102 is a patterned roll 100. The surface 105 of the patterned roll 100 generally comprises two components—elements 110, also referred to herein as male elements, and landing areas 112. The male elements 110 preferably comprise at least about 50 percent of the total surface 105 of the roll 100, such as from about 50 to about 95 percent and more preferably from about 70 to about 90 percent, and still more preferably from about 75 to about 90 percent. The male elements 110 may be discrete, as illustrated in FIG. 2, or may be continuous or semi-continuous. As used herein, the pattern of elements is considered "discrete" if any one element does not extend substantially throughout a principal direction of the roll surface. Further, as used herein, a pattern of protuberances, male elements, is considered to be "semi-continuous" if a plurality of the elements extend substantially throughout one dimension of the apparatus, and each element in the plurality is spaced apart from an adjacent element.

The elements in the semi-continuous pattern may be generally parallel to one another, may form a wave pattern, or form a pattern in which adjacent elements are offset from one another with respect to the phase of the pattern. The semi-continuous element may be aligned in any direction within the plane of the patterned roll surface. Thus, the element may span the entire cross-machine direction of the roll surface, may endlessly encircle the roll surface in the machine direction, or may run diagonally relative to the machine and cross-machine directions.

In other embodiments the male elements may form a continuous pattern. A continuous pattern extends substantially throughout both the machine direction and cross-machine direction of the roll surface, although not necessarily in a straight line fashion. Alternatively, a pattern may be continuous because the framework of elements forms at least one essentially unbroken net-like pattern.

Referring to FIG. 2, a plan view of a portion of the surface of an exemplary pattern roll 100 is shown. The roll 100 may include a first 111 and a second 113 mounting means for rotatably mounting the calender roll. The surface 105 of the pattern roll 100 includes a plurality of discrete male elements 110 that are separated by land areas 112. Generally the male elements 110 comprise a plurality of discrete elements which are raised above the surface of the land areas 112 thereby defining an element height H. In the illustrated embodiment the male elements 110 are uniform and have a generally circular shape, however, the shape of the elements is not so limited. In certain embodiments the male elements may be circular, elliptical, rectangular, rectangular with rounded edges, square, square with rounded edges, trapezoidal, or trapezoidal with rounded edges. Further, although the elements 110 are illustrated as being substantially similar in shape, the invention is not so limited and the elements may be different shapes.

Figure 3:
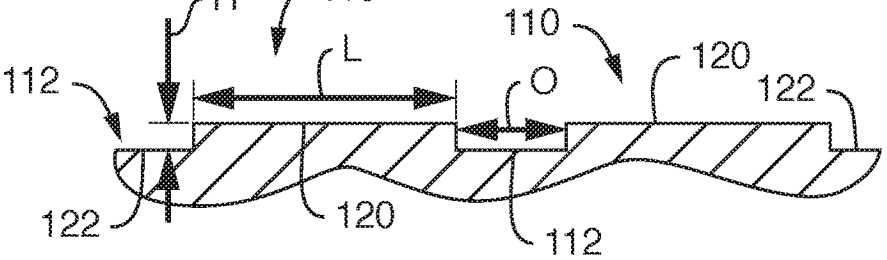
FIG. 3 is a cross-sectional view through line 2-2 of FIG. 2.

Referring further to FIG. 2, in particular embodiments the male elements 110 protrude from the surface 105 of the pattern roll 100 a height (H), which is measured as the distance between the upper surface 120 of the element 110 and the surface 122 of the landing area 112. Generally the upper surface 120 of the element 110 is substantially planar as illustrated in FIG. 3; however, in other embodiments the upper surface may have a slight curvature such that the element has a convex cross-sectional shape. In those embodiments where the upper surface of the element is convex the height (H) is measured from the upper most portion of the element surface. Generally the height (H) is greater than about 0.20 millimeters (mm). In a particularly preferred embodiment the male elements 110 have a height (H) from about 0.20 to about 1.5 mm, such as from about 0.30 to about 1.25 mm and still more preferably from about 0.5 to about 1.00 mm.

As noted previously while the elements 110 are illustrated as having a circular shape, the invention is not so limited and the elements 110 may take a variety of shapes. Regardless, discrete elements 110, such as those illustrated in FIGS. 2 and 3, generally have a length dimension (L) that is measured across the greatest width dimension of the upper surface 120 of the element 110. The length dimension is generally greater than about 20 mm, such as from about 20 to about 100 mm and more preferably from about 40 to about 80 mm. The upper surface 120 of the element 110 generally has a surface area greater than about 300 $mm^2$, such as from about 300 to about 8,000 $mm^2$ and more preferably from about 1,750 to about 3,000 $mm^2$.

The elements 110 are generally surrounded by landing areas 112, which lie out of plane and generally at a lower elevation then the elements. The distance between adjacent elements (D) may vary depending on the spacing and arrangement of the elements and may not be regular throughout the roll surface. In certain embodiments the distance (D) may be less than about 20 mm, such as from about 0.5 to about 20 mm and more preferably from about 5 to about 10 mm.

The sidewall angle of the elements, measured relative to a plane drawn tangent to the surface 105 of the pattern roll 100 at the base of the element 110 is suitably from between about 90 to about 130 degrees.

Without being bound by any theory, it is believed that the combination of element height, element surface area, and total area of element coverage combine to reduce the Z-directional variability of the uncalendered tissue web, making the tissue web surface substantially smoother and more planer, while re-orienting and re-bonding the paper fibers at the surface of the paper web. All of this is accomplished without a significant reduction of the tissue web caliper. As such, the calendering unit of the present invention may be used to manufacture a tissue product that is both bulky and smooth. Further, in certain preferred embodiments, the preservation of sheet caliper and smoothing of the sheet surface may be accomplished without imparting a lasting image or pattern on the web. Thus, the present invention differs from embossing in that a three dimensional image or design is not imparted on the tissue web as a result of passing the web through the nip created by the opposed calender rolls. Accordingly, in certain embodiments the present invention provides a tissue product that has not been embossed and has a substantially smooth, unpatterned surface, and more preferably an unembossed through-air dried tissue product and still more preferably an unembossed uncreped through-air dried tissue web.

The improvement in finished tissue product properties resulting from the inventive calendering method compared to conventional calendering is illustrated in Table 1, below. A single ply through-air dried tissue basesheet having a basis weight of 38.7 gsm and a GMT of about 2600 g/3" was prepared substantially as described in the Examples, below. The basesheet was subjected to conventional calendering by passing the web through a fixed gap calender comprising a smooth steel roll in contact with the air side of the sheet and a 40 P&J polyurethane roll in contact with the fabric side and loaded at 40 PLI. The same basesheet was also subjected to calendering according to the present disclosure substituting the smooth steel roll with a calender roll having male elements covering approximately 75 percent of the surface area of the roll and having a height of approximately 1.15 mm.

TABLE 1

| Sample | BW (gsm) | Caliper (μm) | Stiffness Index | Sheet Bulk (cc/g) | Surface Smoothness | Delta Surface Smoothness (%) | Delta Sheet Bulk (%) | Delta Stiffness Index (%) |
|---|---|---|---|---|---|---|---|---|
| Basesheet | 38.7 | 1217 | 6.07 | 31.40 | 0.4221 | — | — | — |
| Conventional | 37.1 | 618 | 5.56 | 16.7 | 0.2882 | −32% | −47% | −8% |
| Inventive | 37.3 | 695 | 5.22 | 18.6 | 0.2412 | −43% | −41% | −14% |

Accordingly, the foregoing calendering device may be used to produce tissue products that are both bulky and smooth and that have good Roll Structure when wound into rolls. Thus, tissue products produced according to the present disclosure have unique properties that represent an improvement over prior art rolled tissue products. For example, the present disclosure provides tissue products having comparable or better sheet caliper and Sheet Bulk, while also having good Roll Bulk and Roll Structure.

TABLE 2

| Product | Plies | GMT | Sheet Bulk (cc/g) | Caliper (um) | Roll Firmness (mm) | Roll Bulk (cc/g) | Roll Structure |
|---|---|---|---|---|---|---|---|
| Invention | 1 | 2424 | 18.5 | 695 | 6.2 | 18.5 | 2.08 |
| Scott ™ Towels | 1 | 2250 | 19.6 | 518 | 6.3 | 17.6 | 1.45 |
| Scott Naturals ™ Towels | 1 | 2570 | 20.4 | 536 | 5.9 | 16.8 | 1.53 |
| Viva Vantage ™ Towels | 1 | 2612 | 16.1 | 815 | 5.0 | 13.2 | 2.15 |
| Viva ™ Towels | 1 | 1425 | 12.3 | 650 | 4.6 | 11.3 | 1.60 |
| Bounty Basic ™ Towels | 1 | 2712 | 19.0 | 706 | 11.9 | 20.4 | 1.21 |

The tissue products of the present invention generally have a basis weight greater than about 25 gsm, such as from about 28 to about 50 gsm, more preferably from about 30 to about 45 gsm and still more preferably from about 35 to about 40 gsm. At the foregoing basis weights the products are also generally strong enough to withstand use and therefore preferably have a GMT greater than about 1500 g/3", such as from about 1500 to about 3500 g/3", more preferably from about 1750 to about 2750 g/3, and still more preferably from about 2000 to about 2500 g/3". Accordingly, in certain embodiments, rolled products made according to the present disclosure may comprise a spirally wound single-ply tissue web having a basis weight from about 30 to about 45 gsm and a GMT from about 1750 to about 2750 g/3.

Tissue products prepared according to the present invention generally retain a greater amount of their caliper after calendering and as such have both improved caliper and Sheet Bulk. As such, in certain embodiments the tissue products have a caliper greater than about 550 μm, such as from about 550 to about 750 μm, more preferably from about 600 to about 700 μm, and still more preferably from about 610 to about 660 μm. At the foregoing calipers the tissue products generally have Sheet Bulks greater than about 16 cc/g, such as from about 16 to about 24 cc/g and more preferably from about 18 to about 22 cc/g.

Spirally wound rolled products preferably have a Roll Firmness of less than about 8.0 mm, such as from about 4.5 to about 8.0 mm and more preferably from about 5.0 to about 7.0 mm. At the foregoing firmness levels the rolled products of the present invention generally have a Roll Bulk greater than about 15 cc/g, such as from about 15 to about 24 cc/g, more preferably from about 16 to 22 cc/g and still more preferably from about 18 to about 20 cc/g. In one particular embodiment, for instance, the disclosure provides a rolled tissue product comprising a spirally wound single ply tissue web having a GMT from about 1750 to about 2750 g/3, wherein the rolled product has a Roll Firmness from about 5.0 to about 7.0 mm and a Roll Bulk from about 16 to 22 cc/g. Within the above roll firmness ranges, rolls made according to the present disclosure do not appear to be overly soft and "mushy" as may be undesirable by some consumers during some applications.

In the past, at the foregoing roll firmness levels, spirally wound tissue products had a tendency to have low Roll Bulks and/or poor sheet caliper, resulting in undesirable roll aesthetics. It has now been discovered that a rolled tissue product may be produced which retains a greater amount of sheet caliper and bulk and is also smooth and not overly stiff. As such, rolled tissue products prepared according to the present disclosure generally have improved Roll Structure, such as a Roll Structure greater than about 1.5, such as from about 1.5 to about 2.5, more preferably from about 1.8 to about 2.5 and still more preferably from about 2.0 to about 2.5.

In still other embodiments, the present disclosure provides tissue webs having good tensile properties, are flexible and not overly stiff. As such the tissue products generally have a CD Stretch greater than about 8.0 percent, such as from about 8.0 to about 12.0 percent, and more preferably from about 10.0 to about 12.0 percent. In other embodiments the tissue products have a Stiffness Index less than about 8.0, such as from about 4.0 to about 8.0, more preferably from about 4.5 to about 7.0 and still more preferably from about 5.0 to about 6.0.

In addition to the foregoing properties, tissue webs and products produced according to the present invention are generally smoother than webs and products produced by conventional calendering. As such the tissue products generally have a Surface Smoothness less than about 0.260, more preferably less than about 0.240 and still more preferably less than about 0.220, such as from about 0.180 to about 0.260. In other embodiments, in addition to having low Surface Smoothness, the webs and products also have relatively low degrees of MMD, such as an average MMD of less than about 0.020, such as from about 0.014 to about 0.020. The reduction in Surface Smoothness achieved using the inventive patterned calender roll is typically at least about 5 percent, and more preferably at least about 10 percent, and still more preferably at least about 15 percent, greater compared to conventional calendering of a similar basesheet. The reduction in Surface Smoothness is generally achieved without drastically reducing Sheet Bulk; as such the tissue webs and products generally have a Sheet Bulk greater than about 15 cc/g, such as from about 15 to about 20 cc/g and a Surface Smoothness less than about 0.260 and more preferably less than about 0.240.

Webs useful in preparing spirally wound tissue products according to the present disclosure can vary depending upon the particular application. In general, the webs can be made from any suitable type of fiber. For instance, the base web can be made from pulp fibers, other natural fibers, synthetic fibers, and the like. Suitable cellulosic fibers for use in connection with this invention include secondary (recycled) papermaking fibers and virgin papermaking fibers in all proportions. Such fibers include, without limitation, hardwood and softwood fibers as well as nonwoody fibers. Noncellulosic synthetic fibers can also be included as a portion of the furnish.

Tissue webs made in accordance with the present disclosure can be made with a homogeneous fiber furnish or can be formed from a stratified fiber furnish producing layers within the single-ply product. Stratified base webs can be formed using equipment known in the art, such as a multi-layered headbox.

For instance, different fiber furnishes can be used in each layer in order to create a layer with the desired characteristics. For example, layers containing softwood fibers have higher tensile strengths than layers containing hardwood fibers. Hardwood fibers, on the other hand, can increase the softness of the web. In one embodiment, the single ply base web of the present disclosure includes at least one layer containing primarily hardwood fibers. The hardwood fibers can be mixed, if desired, with softwood and/or broke fibers in an amount up to about 40 percent by weight and more preferably from about 15 to about 25 percent by weight. The base web further includes a middle layer positioned in between the first outer layer and the second outer layer. The middle layer can contain primarily softwood fibers. If desired, other fibers, such as high-yield fibers or synthetic fibers may be mixed with the softwood fibers in an amount up to about 10 percent by weight.

When constructing a web from a stratified fiber furnish, the relative weight of each layer can vary depending upon the particular application. For example, in one embodiment, when constructing a web containing three layers, each layer can be from about 15 to about 40 percent of the total weight of the web, such as from about 25 to about 35 percent of the total weight of the web.

Wet strength resins may be added to the furnish as desired to increase the wet strength of the final product. Presently, the most commonly used wet strength resins belong to the class of polymers termed polyamide-polyamine epichlorohydrin resins. There are many commercial suppliers of these types of resins including Hercules, Inc. (Kymene™), Henkel Corp. (Fibrabond™), Borden Chemical (Cascamide™), Georgia-Pacific Corp. and others. These polymers are characterized by having a polyamide backbone containing reactive crosslinking groups distributed along the backbone. Other useful wet strength agents are marketed by American Cyanamid under the Parez™ trade name.

Similarly, dry strength resins can be added to the furnish as desired to increase the dry strength of the final product. Such dry strength resins include, but are not limited to carboxymethyl celluloses (CMC), any type of starch, starch derivatives, gums, polyacrylamide resins, and others as are well known. Commercial suppliers of such resins are the same as those that supply the wet strength resins discussed above.

Another strength chemical that can be added to the furnish is Baystrength 3000 available from Kemira (Atlanta, Ga.), which is a glyoxalated cationic polyacrylamide used for imparting dry and temporary wet tensile strength to tissue webs.

As described above, the tissue product of the present disclosure can generally be formed by any of a variety of papermaking processes known in the art. In one embodiment the base web is formed by an uncreped through-air drying process. Uncreped through-air dried tissue processes useful in practicing the instant invention are described, for example, in U.S. Pat. Nos. 5,656,132 and 6,017,417, both of which are hereby incorporated by reference herein in a manner consistent with the present disclosure.

The forming process of the present disclosure may be any conventional forming process known in the papermaking industry. Such formation processes include, but are not limited to, Fourdriniers, roof formers such as suction breast roll formers, and gap formers such as twin wire formers and crescent formers. Once formed, the wet tissue web is partially dewatered to a consistency of about 10 percent based on the dry weight of the fibers. Additional dewatering of the wet tissue web may be carried out by known paper making techniques, such as vacuum suction boxes, while the inner forming fabric supports the wet tissue web. The wet tissue web may be additionally dewatered to a consistency of at least about 20 percent, more specifically between about 20 to about 40 percent, and more specifically about 20 to about 30 percent.

The forming fabric can generally be made from any suitable porous material, such as metal wires or polymeric filaments. For instance, some suitable fabrics can include, but are not limited to, Albany 84M and 94M available from Albany International (Albany, N.Y.) Asten 856, 866, 867, 892, 934, 939, 959, or 937, and Asten Synweve Design 274, all of which are available from Asten Forming Fabrics, Inc. (Appleton, Wis.); and Voith 2164 available from Voith Fabrics (Appleton, Wis.). Forming fabrics or felts comprising nonwoven base layers may also be useful, including those of Scapa Corporation made with extruded polyurethane foam such as the Spectra Series.

The wet web is then transferred from the forming fabric to a transfer fabric while at a solids consistency of between about 10 to about 35 percent, and particularly, between about 20 to about 30 percent. As used herein, a "transfer fabric" is a fabric that is positioned between the forming section and the drying section of the web manufacturing process.

Preferably the transfer fabric has a three dimensional surface topography, which may be provided by substantially continuous machine direction ridges whereby the ridges are made up of multiple warp strands grouped together, such as those in U.S. Pat. No. 7,611,607, which is incorporated herein in a manner consistent with the present disclosure. Particularly preferred fabrics having a three dimensional surface topography that may be useful as transfer fabrics include fabrics described as Fred (t1207-77), Jetson (t1207-6) and Jack (t1207-12) in U.S. Pat. No. 7,611,607.

Transfer to the transfer fabric may be carried out with the assistance of positive and/or negative pressure. For example, in one embodiment, a vacuum shoe can apply negative pressure such that the forming fabric and the transfer fabric simultaneously converge and diverge at the leading edge of the vacuum slot. Typically, the vacuum shoe supplies pressure at levels between about 10 to about 25 inches of mercury. As stated above, the vacuum transfer shoe (negative pressure) can be supplemented or replaced by the use of positive pressure from the opposite side of the web to blow the web onto the next fabric. In some embodiments, other vacuum shoes can also be used to assist in drawing the fibrous web onto the surface of the transfer fabric.

Typically, the transfer fabric travels at a slower speed than the forming fabric to enhance the MD and CD stretch of the web, which generally refers to the stretch of a web in its cross-machine (CD) or machine direction (MD) (expressed as percent elongation at sample failure). For example, the relative speed difference between the two fabrics can be from about 10 to about 35 percent, in some embodiments from about 15 to about 30 percent, and in some embodiments, from about 20 to about 28 percent. This is commonly referred to as "rush transfer". During "rush transfer", many of the bonds of the web are believed to be broken, thereby forcing the sheet to bend and fold into the depressions on the surface of the transfer fabric 8. Such molding to the contours of the surface of the transfer fabric may increase the MD and CD stretch of the web. Rush transfer from one fabric to another can follow the principles taught in any one of the following patents, U.S. Pat. Nos. 5,667,636, 5,830,321, 4,440,597, 4,551,199, 4,849,054, all of which are hereby incorporated by reference herein in a manner consistent with the present disclosure.

The wet tissue web is then transferred from the transfer fabric to a throughdrying fabric. Typically, the transfer fabric travels at approximately the same speed as the throughdrying fabric. The transfer may be carried out with vacuum assistance to ensure conformation of the wet tissue web to the topography of the throughdrying fabric. While supported by the throughdrying fabric, the wet tissue web is dried to a final consistency of about 94 percent or greater by a throughdryer. The web then passes through the winding nip between the reel drum and the reel and is wound into a roll of tissue.

The roll of tissue is subsequently subjected to calendering as described above. In accordance with the present disclosure, the base web of the tissue product is subjected to a calendering process in order to slightly reduce sheet caliper, increase smoothness, decrease stiffness, while maintaining sufficient tensile strength. The calendering process compresses the web, effectively breaking some bonds formed between the fibers of the base web. In this manner, calendering may smooth the surface of the sheet and increase the perceived softness of the tissue product. Preferably the bulk of the tissue web can be largely maintained during calendering. At the very least, through this process, a greater amount of bulk is preserved compared to conventional calendering. This higher Sheet Bulk is manifested as higher product Roll Bulk at a fixed firmness while maintaining the required sheet softness.

Surface Smoothness

The surface properties of samples were measured on KES Surface Tester (Model KE-SE, Kato Tech Co., Ltd., Kyoto, Japan). For each sample the surface smoothness was measured according to the Kawabata Test Procedures with samples tested along MD and CD and on both sides for five repeats with a sample size of 10 cm×10 cm. Care was taken to avoid folding, wrinkling, stressing, or otherwise handling the samples in a way that would deform the sample. Samples were tested using a multi-wire probe of 10 mm×10 mm consisting of 20 piano wires of 0.5 mm in diameter each with a contact force of 25 grams. The test speed was set at 1 mm/s. The sensor was set at "H" and FRIC was set at "DT". The data was acquired using KES-FB System Measurement Program KES-FB System Ver 7.09 E for Win98/2000/XP by Kato Tech Co., Ltd., Kyoto, Japan. The selection in the program was "KES-SE Friction Measurement".

KES Surface Tester determined the coefficient of friction (MIU) and mean deviation of MIU (MMD), where higher values of MIU indicate more drag on the sample surface and higher values of MMD indicate more variation or less uniformity on the sample surface.

The values MIU and MMD are defined by:

$$MIU(\bar{\mu})=1/X\int_0^x \mu dx$$

$$MMD=1/X\int_0^x |\mu-\bar{\mu}|dx$$

where $\mu$=friction force divided by compression force $\bar{\mu}$=mean value of $\mu$ x=displacement of the probe on the surface of specimen, cm X=maximum travel used in the calculation, 2 cm The cross-machine (CD) and machine direction (MD) MIU and MMD values were obtained for both the top and bottom surface of each tissue product sample. Each sample was tested five times and the results averaged to arrive at the reported value. For a given surface (top or bottom) the MMD and MIU values are reported as the square root of the product of MIU-CD and MIU-MD or MMD-CD and MMD-MD. To calculate Surface Smoothness the square root of the product of MIU-CD and MIU-MD for the top and bottom surfaces were averaged.

Tensile

Samples for tensile strength testing are prepared by cutting a 3" (76.2 mm)×5" (127 mm) long strip in either the machine direction (MD) or cross-machine direction (CD) orientation using a JDC Precision Sample Cutter (Thwing-Albert Instrument Company, Philadelphia, Pa., Model No. JDC 3-10, Ser. No. 37333). The instrument used for measuring tensile strengths is an MTS Systems Sintech 11S, Serial No. 6233. The data acquisition software is MTS TestWorks™ for Windows Ver. 4 (MTS Systems Corp., Research Triangle Park, N.C.). The load cell is selected from either a 50 or 100 Newton maximum, depending on the strength of the sample being tested, such that the majority of peak load values fall between 10 and 90 percent of the load cell's full scale value. The gauge length between jaws is 4±0.04 inches. The jaws are operated using pneumatic-action and are rubber coated. The minimum grip face width is 3" (76.2 mm), and the approximate height of a jaw is 0.5 inches (12.7 mm). The crosshead speed is 10±0.4 inches/min (254±1 mm/min), and the break sensitivity is set at 65 percent. The sample is placed in the jaws of the instrument, centered both vertically and horizontally. The test is then started and ends when the specimen breaks. The peak load is recorded as either the "MD tensile strength" or the "CD tensile strength" of the specimen depending on the sample being tested. At least six representative specimens are tested for each product, taken "as is," and the arithmetic average of all individual specimen tests is either the MD or CD tensile strength for the product.

EXAMPLES

Base sheets were made using a through-air dried papermaking process commonly referred to as "uncreped through-air dried" (UCTAD) and generally described in U.S. Pat. No. 5,607,551, the contents of which are incorporated herein in a manner consistent with the present invention. Base sheets with a target bone dry basis weight of about 38 grams per square meter (gsm) were produced. The base sheets were then converted and spirally wound into rolled tissue products.

In all cases the base sheets were produced from a furnish comprising northern softwood kraft (NSWK) and eucalyptus kraft (EHWK) using a layered headbox fed by three stock chests such that the webs having three layers (two outer layers and a middle layer) were formed. The tissue web was formed on a Voith Fabrics TissueForm V forming fabric, vacuum dewatered to approximately 25 percent consistency and then subjected to rush transfer when transferred to the transfer fabric. The layer splits, by weight of the web, were 30 wt % EHWK/40 wt % NSWK/30 wt % EHWK. Strength was controlled via the addition of CMC, Kymene and/or by refining the NSWK furnish of the center layer.

The wet tissue web was transferred to a transfer fabric designated as Fred, previously described in U.S. Pat. No. 7,611,607 and commercially available from Voith Fabrics, Appleton, Wis. The web was then transferred to a through-air drying fabric designated as t-1205-2, previously described in U.S. Pat. No. 8,500,955 and commercially available from Voith Fabrics, Appleton, Wis. Transfer to the throughdrying fabric was done using vacuum levels of greater than 10 inches of mercury at the transfer. The web was then dried to approximately 98 percent solids before winding.

The base sheet webs were converted into various rolled towels. Specifically, base sheet was calendered using either a conventional polyurethane/steel calender comprising a 40 P&J polyurethane roll on the air side of the sheet and a standard steel roll on the fabric side at a load of 40 PLI, or a polyurethane/patterned steel calender comprising a 40 P&J polyurethane roll on the air side of the sheet and a patterned steel roll on the fabric side at a load of 40 PLI. Process conditions for each sample are provided in Table 3, below. All rolled products comprised a single ply of base sheet.

TABLE 3

| Sample | Calender Load (pli) | Male Element Height (mm) | Pattern Roll Male Element Surface Area (% of Roll Surface Area) |
|---|---|---|---|
| Control | 40 | — | — |
| Roll 1 | 40 | 1.145 | 90 |
| Roll 2 | 40 | 0.40 | 90 |
| Roll 3 | 40 | 1.145 | 75 |
| Roll 4 | 40 | 0.40 | 75 |

TABLE 4

| Sample | Basis Weight (gsm) | Caliper (microns) | Sheet Bulk (cc/g) | GMT (g/3") | CD Stretch (%) | GM Slope (kg) | Stiffness Index |
|---|---|---|---|---|---|---|---|
| Control | 37.1 | 618 | 16.7 | 2251 | 9.6 | 12.51 | 5.56 |
| Roll 1 | 37.5 | 648 | 17.3 | 2360 | 10.1 | 12.27 | 5.20 |
| Roll 2 | 37.6 | 638 | 16.9 | 2362 | 9.7 | 13.07 | 5.53 |
| Roll 3 | 37.3 | 695 | 18.6 | 2424 | 9.9 | 12.66 | 5.22 |
| Roll 4 | 37.6 | 666 | 17.7 | 2340 | 10.1 | 12.35 | 5.28 |

TABLE 5

| Sample | Roll Firmness (mm) | Roll Bulk (cc/g) | Roll Structure | Top Surface MIU | Bottom Surface MIU | Surface Smoothness | Average MMD |
|---|---|---|---|---|---|---|---|
| Control | 5.7 | 16.4 | 1.77 | 0.3074 | 0.2688 | 0.2882 | 0.0223 |
| Roll 1 | 6.1 | 17.6 | 1.86 | 0.2627 | 0.2330 | 0.2478 | 0.0204 |
| Roll 2 | 5.6 | 16.6 | 1.90 | 0.2372 | 0.2286 | 0.2418 | 0.0196 |
| Roll 3 | 6.2 | 18.5 | 2.08 | 0.2554 | 0.2280 | 0.2412 | 0.0194 |
| Roll 4 | 5.2 | 17.7 | 2.28 | 0.2662 | 0.2161 | 0.2326 | 0.0179 |

While the invention has been described in detail with respect to the foregoing specification and examples, the following embodiments, as well as equivalents thereof, are within the scope of the invention. Accordingly, in a first embodiment the present invention provides a rolled tissue product comprising a calendered tissue web spirally wound into a roll, the product having a Roll Bulk greater than about 15 cc/g, a Roll Firmness from about 5.0 to about 7.0 and a Roll Structure greater than about 1.80.

In a second embodiment the present invention provides the rolled tissue product of the first embodiment having a Surface Smoothness less than about 0.260, such as from about 0.200 to about 0.260.

In a third embodiment the present invention provides the rolled tissue product of the first or the second embodiment having a Sheet Bulk greater than about 15 cc/g, such as from about 15 to about 20 cc/g.

In a fourth embodiment the present invention provides the rolled tissue product of any one the first through third embodiments having a GMT greater than about 1750 g/3", such as from about 1750 to about 3000 g/3".

In a fifth embodiment the present invention provides the rolled tissue product of any one the first through fourth embodiments having a CD Stretch greater than about 8 percent, such as from about 8 to about 12 percent.

In a sixth embodiment the present invention provides the rolled tissue product of any one the first through fifth embodiments having a GM Slope less than about 15 kg, such as from about 10 to about 15 kg and a Stiffness Index less than about 7, such as from about 5 to about 7.

In a seventh embodiment the present invention provides the rolled tissue product of any one the first through sixth embodiments having a caliper greater than about 640 μm, such as from about 640 to about 700 μm.

In an eighth embodiment the present invention provides a bulky and smooth calendered tissue web having a Sheet Bulk greater than about 15 cc/g and Surface Smoothness less than about 0.260.

In a ninth embodiment the present invention provides the web of the eighth embodiment having a Sheet Bulk greater than about 15 cc/g, such as from about 15 to about 20 cc/g.

In a tenth embodiment the present invention provides the eighth or ninth embodiment having a GMT greater than about 1750 g/3", such as from about 1750 to about 3000 g/3".

In an eleventh embodiment the present invention provides the web of any one of the eighth through tenth embodiments having a CD Stretch greater than about 8 percent, such as from about 8 to about 12 percent.

In a twelfth embodiment the present invention provides the rolled tissue product of any one of the eighth through eleventh embodiments having a GM Slope less than about 15 kg, such as from about 10 to about 15 kg and a Stiffness Index less than about 7, such as from about 5 to about 7.

In a thirteenth embodiment the present invention provides the rolled tissue product of any one of the eighth through twelfth embodiments wherein the tissue web is an uncreped through-air dried web and has not been subject to embossing.

What is claimed is:

1. A rolled tissue product comprising a calendered tissue web spirally wound into a roll, the calendered tissue web having a basis weight from 30 to 40 grams per square meter (gsm), a sheet bulk from about 16 to about 24 cc/q, a caliper from about 610 to about 660 μm and a geometric mean tensile strength (GMT) from about 1750 to about 2750 g/3", the rolled tissue product having a roll bulk greater than about 15 cc/g, a roll firmness from about 5.0 to about 7.0 and a Roll Structure greater than about 1.80.

2. The rolled tissue product of claim 1 wherein the calendered tissue web has a surface smoothness less than about 0.260.

3. The rolled tissue product of claim 1 wherein the product has a roll bulk from about 16 to about 22 cc/g and a roll firmness from about 5.0 to about 7.0 mm.

4. The rolled tissue product of claim 1 wherein the calendered tissue web has a cross-machine direction (CD) stretch from about 8 to about 12 percent.

5. The rolled tissue product of claim 1 wherein the calendered tissue web has a geometric mean slope (GM Slope) from about 10 to about 15 kg and a Stiffness Index from about 5 to about 7.

6. The rolled tissue product of claim 1 wherein the calendered tissue web comprises a single-ply through-air dried tissue web.

7. A bulky and smooth calendered tissue web comprising a single-ply calendered through-air dried tissue web having a basis weight from 30 to 40 grams per square meter (gsm), a sheet bulk from about 16 to about 24 cc/g, a caliper from about 610 to about 660 μm and a geometric mean tensile strength (GMT) from about 1750 to about 2750 g/3 and Surface Smoothness less than about 0.260.

8. The bulky and smooth calendered tissue web of claim 7 having a Surface Smoothness from about 0.20 to about 0.26.

9. The bulky and smooth calendered tissue web of claim 7 having a cross-machine direction(CD) stretch from about 8 to about 12 percent.

10. The bulky and smooth calendered tissue web of claim 7 having a geometric mean slope (GM Slope) from about 10 to about 15 kg and a Stiffness Index from about 5 to about 7.

11. A rolled tissue product comprising a calendered single-ply tissue web spirally wound into a roll, the web having a basis weight from 30 to 40 grams per square meter (gsm), a sheet bulk from about 16 to about 24 cc/g, a caliper from about 610 to about 660 μm and a geometric mean tensile strength (GMT) from about 1750 to about 2750 g/3, and the rolled product having a Roll Structure from about 2.0 to about 2.5.

12. The rolled tissue product of claim 11 wherein the web has a Surface Smoothness from about 0.014 to about 0.020.

13. The rolled tissue product of claim 11 wherein the web has a geometric mean slope (GM Slope) from about 10 to about 15 kg and a Stiffness Index from about 5 to about 7.

* * * * *